US006076958A

United States Patent [19]

Althouse, III et al.

[11] Patent Number: 6,076,958

[45] Date of Patent: Jun. 20, 2000

[54] IMPELLER WITH FOLDING BLADE AND METHOD FOR USING THE SAME

[75] Inventors: James W. Althouse, III, Hudson; Wayne A. Palascak, North Olmsted, both of Ohio

[73] Assignee: ProQuip, Inc., Macedonia, Ohio

[21] Appl. No.: 09/280,533

[22] Filed: Mar. 30, 1999

[51] Int. Cl.[7] ..... B01F 7/20

[52] U.S. Cl. ..... 366/286; 366/308; 366/331

[58] Field of Search ..... 366/242–252, 366/262–265, 270, 285, 286, 308, 331; 416/142, 143

[56] References Cited

U.S. PATENT DOCUMENTS

| | | | |
|---|---|---|---|
| 612,349 | 10/1898 | Kollenberg . | |
| 780,926 | 1/1905 | Welds | 366/286 |
| 1,034,244 | 7/1912 | Johnson et al. | 366/286 |
| 1,065,806 | 6/1913 | Hollingsworth | 366/286 |
| 1,335,258 | 3/1920 | Riley | 366/286 |
| 1,504,867 | 8/1924 | Cannon | 366/286 |
| 1,711,114 | 4/1929 | Hunt . | |
| 1,734,120 | 11/1929 | Farrington | 366/308 |
| 1,835,284 | 12/1931 | Crowhurst . | |
| 1,841,435 | 1/1932 | Gibson | 366/308 |
| 2,896,926 | 7/1959 | Chapman . | |
| 3,455,540 | 7/1969 | Marcmann | 366/308 |
| 3,559,962 | 2/1971 | Enssle et al. . | |
| 4,083,653 | 4/1978 | Stiffler | 366/308 |
| 4,234,447 | 11/1980 | Hay, II et al. . | |
| 4,519,714 | 5/1985 | Johnson et al. . | |
| 4,582,638 | 4/1986 | Homer et al. . | |
| 4,647,213 | 3/1987 | Hay, II . | |
| 4,836,687 | 6/1989 | Kardoes et al. . | |
| 5,192,131 | 3/1993 | Harfield | 366/308 |
| 5,282,681 | 2/1994 | Supelak . | |
| 5,366,289 | 11/1994 | Supelak . | |
| 5,489,151 | 2/1996 | Weber | 366/308 |
| 5,885,001 | 3/1999 | Thomas | 366/308 |
| 5,941,636 | 8/1999 | Lu | 366/249 |

FOREIGN PATENT DOCUMENTS

| | | | |
|---|---|---|---|
| 60-179127 | 9/1985 | Japan | 366/308 |

*Primary Examiner*—Charles E. Cooley
*Attorney, Agent, or Firm*—D. Peter Hochberg; William H. Holt

[57] ABSTRACT

An impeller mixer assembly is provided for stirring a radioactive material in a vessel having a combination of liquid and solid substances, until that combination turns into a liquid slurry that can be pumped out of the vessel. The impeller mixing assembly includes a folding blade assembly for stirring the radioactive material in the vessel. The folding blade assembly has a folded position when a mixing shaft assembly is not rotating, and an open position when the mixing shaft and the folding blade assembly are rotated at a predetermined speed and the folding blade assembly is submerged in the radioactive substance. A method is provided for stirring a radioactive material in a vessel having a combination of liquid and solid substances, until that combination turns into a liquid slurry that can be pumped out of the vessel. The method includes providing an impeller mixer assembly having a folding blade assembly disposed at an end of a mixing shaft assembly, where the mixing shaft assembly is rotatable by a motor and the folding blade assembly includes an open position and a folded position. The end of the mixing shaft assembly having the folding blade assembly disposed at the end in its folded position is placed at a predetermined depth in radioactive material to be stirred. The impeller shaft assembly is rotated to a predetermined speed, which causes the folding blade assembly to enter the open position from its folded position, and mixes the combination of liquid and solids to a pumpable slurry for pumping out of the vessel.

7 Claims, 3 Drawing Sheets

IMPELLER WITH FOLDING BLADE AND METHOD FOR USING THE SAME

BACKGROUND OF THE INVENTION

1. Field of the Invention

The present invention relates generally to the cleanup of vessels containing radioactive waste, and more particularly to an impeller device with a folding blade assembly that can be inserted into a small entrance in the vessel and rotated to mix the radioactive waste into a pumpable slurry, which can then be pumped out of the vessel.

2. Description of the Prior Art

There are a large number of vessels of various sizes and shapes buried underground throughout the United States, which contain radioactive waste. Many of these vessels are leaking and must be cleaned out, and the waste disposed of properly. In many cases, the waste is not a pure liquid, but contains dirt, sand, crystallized salts and various other solid particles. These particles are also a hazard. In order to clean these vessels, the waste must be mobilized into a liquid or slurry that can be pumped out of the vessel. One way to mobilize these materials is by agitating the liquid and solid mixture with a mechanical mixer.

The difficulty with this process is that most of these vessels are not readily accessible with any standard type of mixer. Most of these vessels usually have very small ports on the top surface of the vessel; therefore, a normal size mixer impeller will not fit through these ports, and it is too dangerous to attempt to assemble an impeller through the port itself. Additionally, the agitator should also be removable from the vessel after mobilization and after the cleansing process has been completed, so that the tank can be removed from the ground, filled with concrete or made safe by other means.

SUMMARY OF THE INVENTION

In accordance with a preferred embodiment of the present invention, an impeller mixer assembly is provided for stirring a radioactive material in a vessel having a combination of liquid and solid substances, until that combination turns into a liquid slurry that can be pumped out of the vessel. The impeller mixing assembly includes a mixing shaft assembly dimensioned to fit through a vessel opening in the vessel. Motor means is provided for rotating the mixing shaft assembly. The impeller mixing assembly includes a folding blade means for stirring the radioactive material in the vessel. The folding blade means is disposed on the mixing shaft assembly. Further, the folding blade means has a folded position when the mixing shaft assembly is not rotating. The folding blade means is dimensioned to fit through the vessel opening in its folded position. The folding blade means also has an open position when the mixing shaft and the folding blade means are inserted through the vessel opening, the mixing shaft assembly is rotated to a predetermined speed and the folding blade means is submerged in the radioactive substance.

In a preferred aspect of the invention, an impeller mixer assembly is provided for stirring a radioactive material in a vessel having a combination of liquid and solid substances until that combination turns into a liquid slurry that can be pumped out of the vessel. The impeller mixer assembly includes a mixing shaft assembly having an end dimensioned to fit through a vessel opening in the vessel. Motor means is provided for rotating the mixing shaft assembly. The impeller mixer assembly includes a first folding blade assembly disposed on the mixing shaft assembly at a location away from the end dimensioned to fit through the vessel opening. The first folding blade assembly is slideably engageable with the mixing shaft assembly along the longitudinal axis of the mixing shaft assembly. A second folding blade assembly is provided, which is disposed on the end of the mixing shaft assembly dimensioned to fit through the vessel opening. The first and second folding blade assemblies have a folded position when the mixing shaft assembly is not rotating, and have an open position when the mixing shaft and the first and second blade assembly are inserted through the vessel opening, the mixing shaft assembly is rotated to a predetermined speed and the first and second folding blade assembly are submerged in the radioactive substance.

The invention also provides for a method for stirring a radioactive material in a vessel having a combination of liquid and solid substances, until that combination turns into a liquid slurry that can be pumped out of the vessel. The method begins with the step of providing an impeller mixer assembly having a first folding blade assembly disposed at an end of a mixing shaft assembly, where the mixing shaft assembly is rotatable by motor means and the folding blade assembly includes an open position and a folded position. The next step includes inserting the end of the mixing shaft assembly having the folding blade assembly disposed at the end in its folded position through a vessel opening and locating the folding blade assembly at a predetermined depth in radioactive material to be stirred. Additionally, the method provides for rotating the impeller shaft assembly by the motor means to a predetermined speed, and causing the folding blade assembly to enter the open position from its folded position and mixing the combination of liquid and solids to a pumpable slurry. The method then provides for pumping the slurry out of the vessel until the vessel is empty, and causing the impeller mixer assembly to stop rotating by the motor means, so that the folding blade assembly can return to its folded position. Finally, the method includes the step of removing the end of the impeller mixer shaft assembly from the vessel through the vessel opening.

The general object of the present invention is to provide an improved method and apparatus for the removal of radioactive material in a vessel that contains a combination of liquid and solid substances by agitating the liquid and solid into a pumpable slurry that can be pumped out of the vessel.

Another object of the present invention is to provide an apparatus for the above general objective that includes an impeller assembly that is adjustable depending on the depth of the radioactive substance remaining in the vessel.

A further object of the present invention is to provide an apparatus for the above general objective that includes an impeller assembly that is adjustable depending on the size of the vessel to be cleaned.

Another object of the present invention is to provide an apparatus for the above general objective that is removal from the vessel to be cleaned.

A further object of the present invention is to provide an apparatus for the above general objective that uses a folding blade assembly that does not use hydraulics for opening the blade assembly for agitation of the liquid and solid substances.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DESCRIPTION OF THE PREFERRED EMBODIMENT

Figure 1:
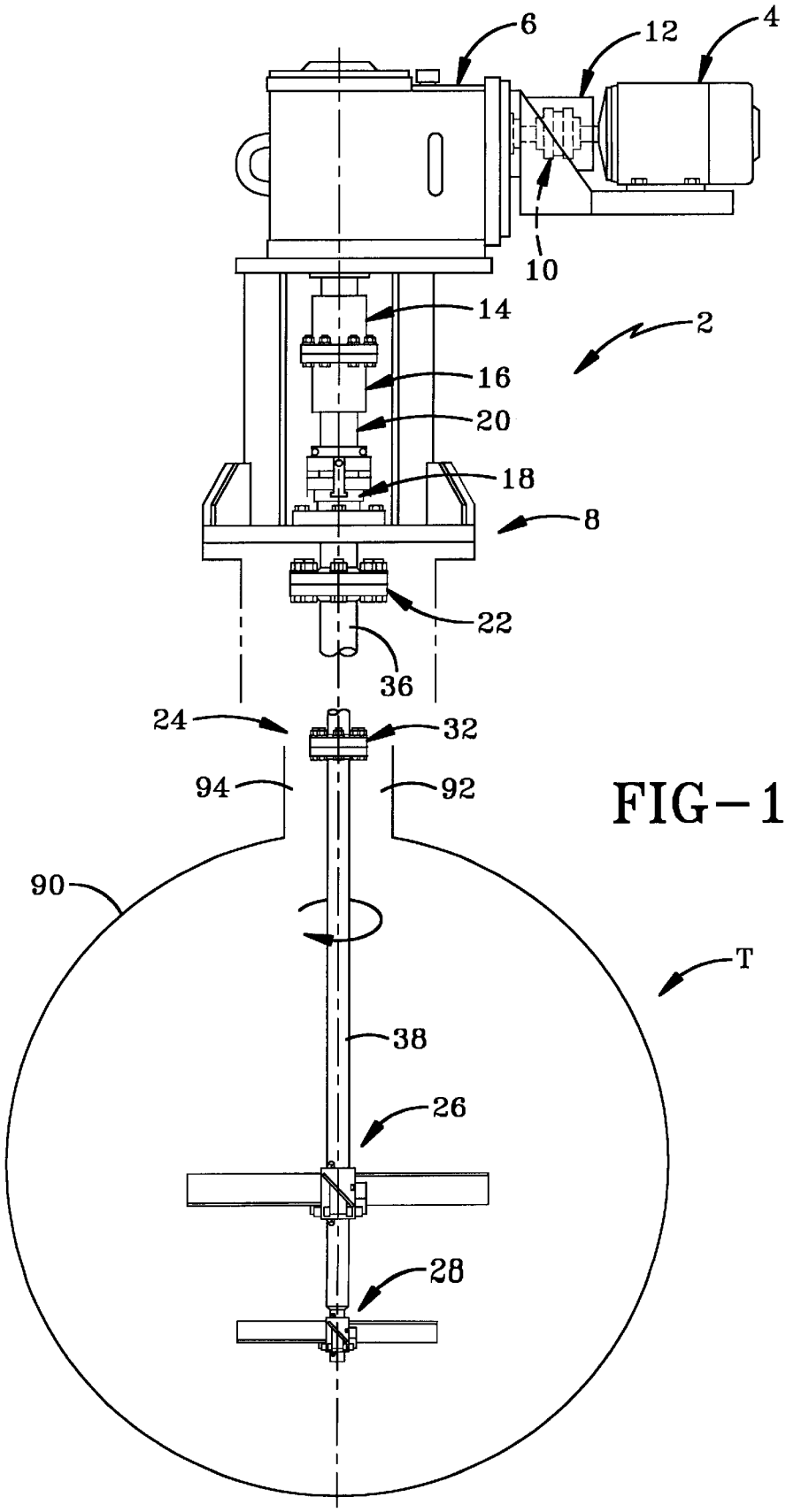
FIG. 1 is a side view of a preferred embodiment of the invention with a mixing shaft disposed in a tank.

Referring now to the drawings wherein the showings are for the purpose of illustrating the preferred embodiment in the invention only, and not for the purpose of limiting the same, FIG. 1 shows an impeller assembly 2 having a motor 4 being connected to a reducer 6 by a high speed coupling assembly 10. High speed coupling assembly 10 includes a high speed coupling guard 12 for ensuring safety to operators, who are running impeller assembly 2. Reducer 6 is connected to a low speed coupling assembly 15, which includes a low speed coupling hub 14 and a low speed removable coupling hub 16, which will be explained in greater detail later in the description of the preferred embodiment. Low speed removable coupling hub 16 is connected to seal shaft 20, which extends through a base 8. Since base 8 remains stationery during use and seal shaft 20 rotates, a mechanical seal 18 is provided to ensure an airtight seal during rotation of seal shaft 20.

A first intank coupling assembly 22 is provided for interconnecting seal shaft 20 to a mixer shaft assembly 24. A first large impeller blade assembly 26 and a smaller impeller blade assembly 28 are disposed at an open end of mixer shaft assembly 24. In the preferred embodiment of the invention, mixer shaft assembly 24 includes a first mixer shaft 36 and a second mixer shaft 38. Second mixer shaft 38 is connected to first mixer shaft 36 by a second intank coupling assembly 32. This allows for variations in the length of either mixer shaft 36 or 38 depending on the depth and size of the vessel that is to be cleaned.

Figure 2:
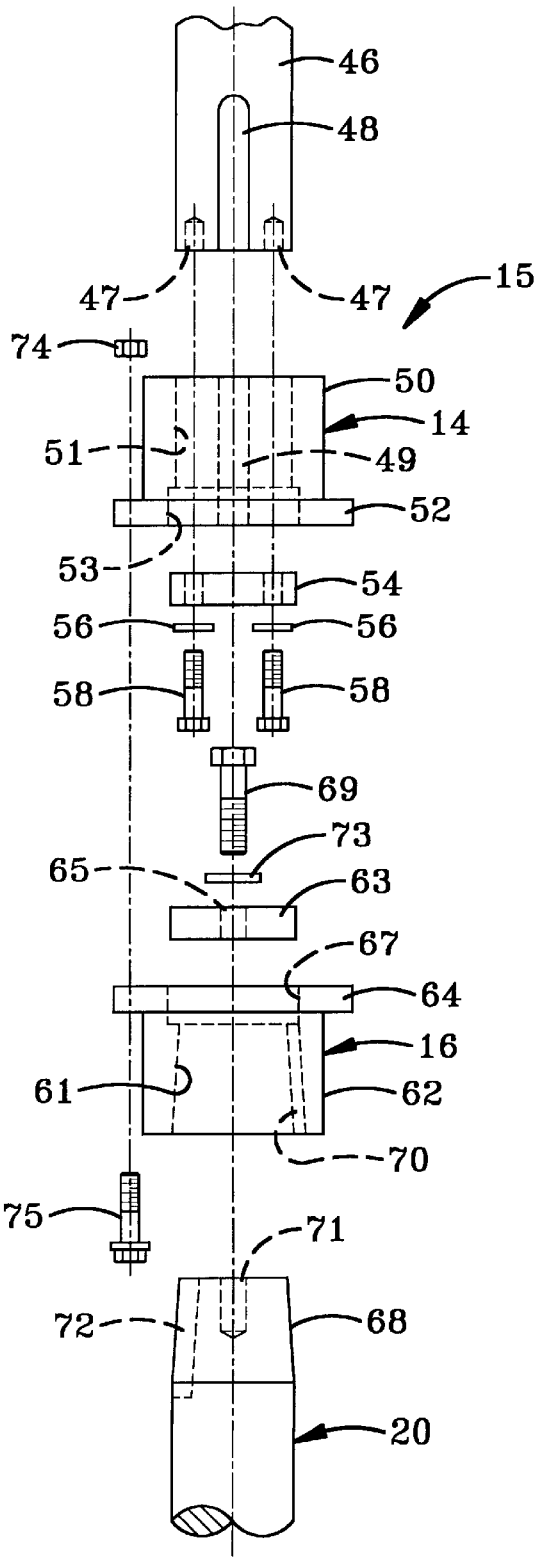
FIG. 2 is a side view of a low speed coupling assembly.

Referring now to FIG. 2, the assembly of the low speed coupling assembly 15 is shown. A reducer output shaft 46 extends vertically downward from reducer 6. Reducer output shaft 46 includes a pair of threaded holes 47 at its end for receiving a pair of hex head cap screws 58. A reducer key slot 48 extends longitudinally along the outer annular surface of output shaft 46. Low speed coupling hub 14 is comprised of a cylindrical collar portion 50 and an annular peripheral flange portion 52 disposed at an end of collar portion 50. Low speed coupling hub 14 includes a cylindrical bore 51 extending through the longitudinal axis of low speed coupling hub 14. Bore 51 includes a key portion 49 for mating to key slot 48 of output shaft 46. An inner circular base 53 is disposed at the end of the bore 51 and has annular peripheral flange portion 52. Inner circular base 53 has a diameter that is greater than the diameter of cylindrical bore 51, and is dimensioned to receive a reducer low speed coupling retainer plate 54. Retainer plate 54 is held in inner circular base 53 by hexhead cap screws 58, lock washers 56 and threaded bores 47. Low speed coupling 14 is coupled to reducer output shaft 46 by cylindrical bore 51 over reducer shaft 46, so that slot 48 mates with key portion 49. Retainer plate 54 is then placed in the other end of bore 51, until retainer plate 54 engages inner circular base 53. Hexhead cap screws 58 then extend through a pair of cylindrical apertures in retainer plate 54, and also through bore 51 in low speed coupling hub 14 to be received in the threaded fastening holes 47 of reducer output shaft 46. The hexhead cap screws 58 are then threaded into threaded fastening holes 42 holding low speed coupling hub 14 to reducer shaft 46.

Low speed removable coupling hub 16 includes a similar assembly to low speed coupling hub 14, which will now be described. Low speed removable coupling hub 16 also includes a cylindrical collar portion 62, a cylindrical peripheral flange 64 and a cylindrical bore 61 extending through coupling hub 16. An inner circular base 67 is disposed in bore 61 near the cylindrical peripheral flange 64 dimensioned to receive a low speed removable coupling retainer plate 63. Low speed removable coupling retainer plate 63 includes a central hole 65 for receiving a hexhead cap screw 69. Bore 61 is tapered away from cylindrical peripheral flange 64, and adapted to receive a tapered end 68 of seal shaft 20. Bore 61 includes a key portion 70 adapted to mate with a key slot 72 that extends longitudinally along the outer annual surface of seal shaft 20. Seal shaft 20 further includes a threaded hole 71 at a tapered end 68 located at its central axis for receiving hex head cap screw 69. Low speed removable coupling hub 16 is coupled to seal shaft 20 by sliding bore 61 over the tapered end of seal shaft 20, so that slot 72 mates with key portion 70. Removable retainer plate 63 is then placed in the other end of bore 61, until retainer plate 63 engages inner circular base 67. Hexhead cap screw 69 then extends through aperture 65 in retainer plate 63, through bore 61 in low speed removable coupling hub 16 to be received in the threaded fastening hole 71 of seal shaft 20. The hexhead cap screw 69 is then threaded into threaded fastening hole 71 holding low speed removable coupling hub 16 to seal shaft 20. The peripheral flange portions 52 and 64 of both coupling hubs 14 and 16 include a plurality of apertures for receiving hexhead cap screws 75 that fasten and hold low speed coupling hub 14 to low speed removable coupling hub 16 via hexhead nuts 74.

Figure 3:
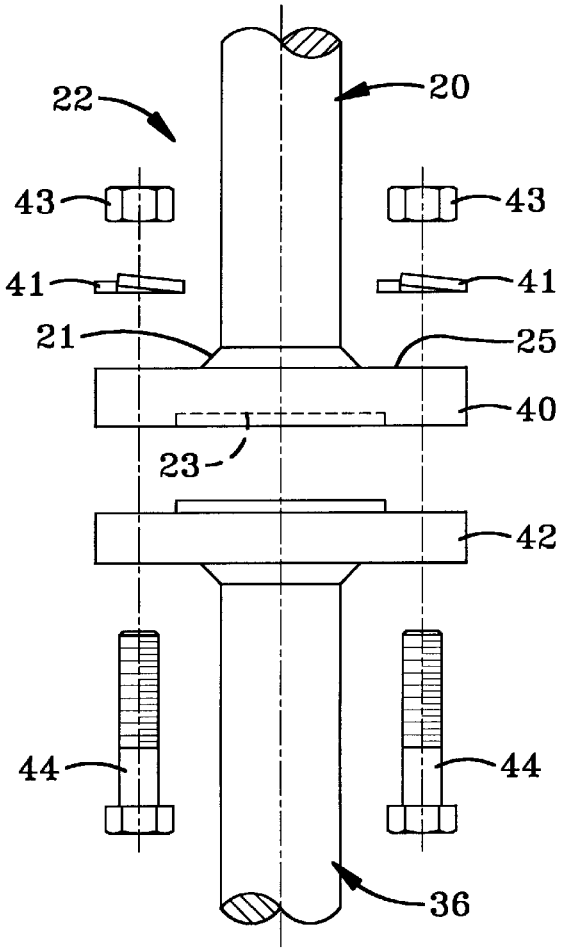
FIG. 3 is a side view of an intank coupling assembly.

It should be appreciated that coupling assembly 22 and coupling assembly 32 are essentially the same and only one will need to be explained to give a complete understanding of both. The only difference is that coupling assembly 22 connects first mixer shaft 36 to seal shaft 20, while coupling assembly 32 connects first mixer shaft 36 to second mixer shaft 38. Referring now to FIG. 3, intank coupling assembly 22 is shown. Intank coupling assembly 22 includes a first collar 40 placed around seal shaft 20. The end of seal shaft 20 includes a frustoconical shaped end 21, while collar 40 includes a bore 23 extending through the center of collar 40. Bore 23 has a diameter greater than the top of the frustoconical shaped end 21, but not the bottom of the frustoconical shaped end 21, such that the inside of the bore 23 slides over the top of frustoconical shaped end 21 and engages the bottom portion of frustoconical shaped end 21. A second collar 42 is provided, essentially identical to collar 40, which fits over first mixer shaft 36 having the same frustoconical shaped end as frustoconical shaped end 21 of seal shaft 20. Collar 42 fits over the end of mixer shaft 36 in the same manner as collar 40 fits over the end of seal shaft 20. Both collar 40 and collar 42 include an outer annular flange portion 25 having a plurality of holes extending therethrough and dimensioned to receive hexhead bolts 44. The plurality of holes on flange portion 25 on both collars 40 and 42 line up with one another, so that hexhead bolts 44 can be placed through the holes and fasten collar 40 to collar 42 and seal shaft 20 to first mixing shaft 36 with the aid of lock washers 41 and hexhead nut 43.

As can be seen in FIG. 1, the preferred embodiment includes a double blade assembly system having small impeller blade assembly 28 disposed at the very end of second mixer shaft 38, and large impeller blade assembly 26 disposed at a location on the mixer shaft above the small impeller blade assembly 28. Preferably, large impeller blade assembly 26 is slideably engageable with second mixer shaft 38, so that the blade can be moved along the longitudinal axis of second mixer shaft 38 depending on the depth of the radioactive material remaining in the tank to be cleaned. Typically, the optimum size of small blade assembly 28 is chosen depending on the radius of the bottom of tank T. This is because most of the solid substances will accumulate at the bottom of tank T near its central axis. Typically the optimum size of large blade assembly 26 is chosen depending on the depth of the liquid and solid substance, and the ratio of liquid to solid substance remaining in tank T. This is because the size of blade assembly 26 will determine the extent that the radioactive substance is agitated.

Figure 4:
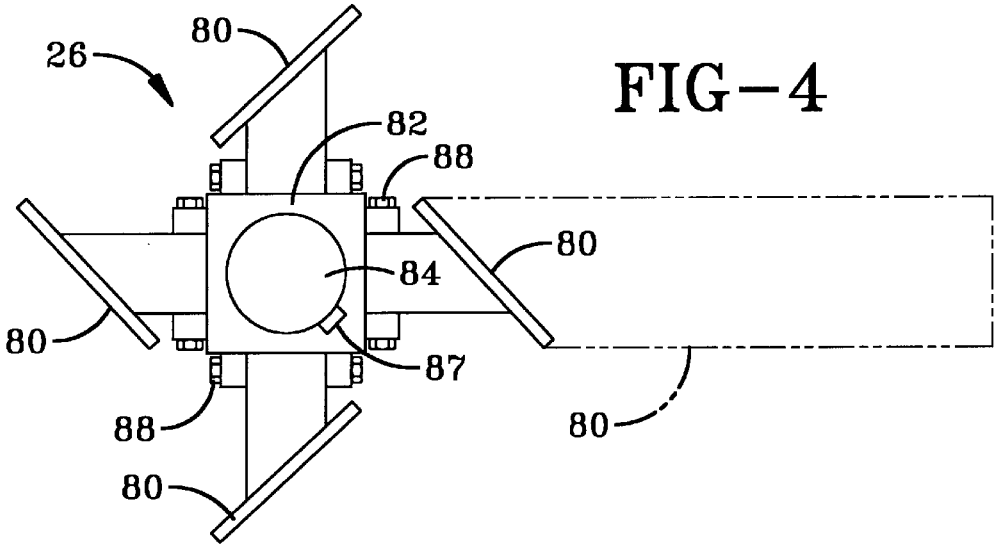
FIG. 4 is a top view of a blade assembly.
Figure 5:
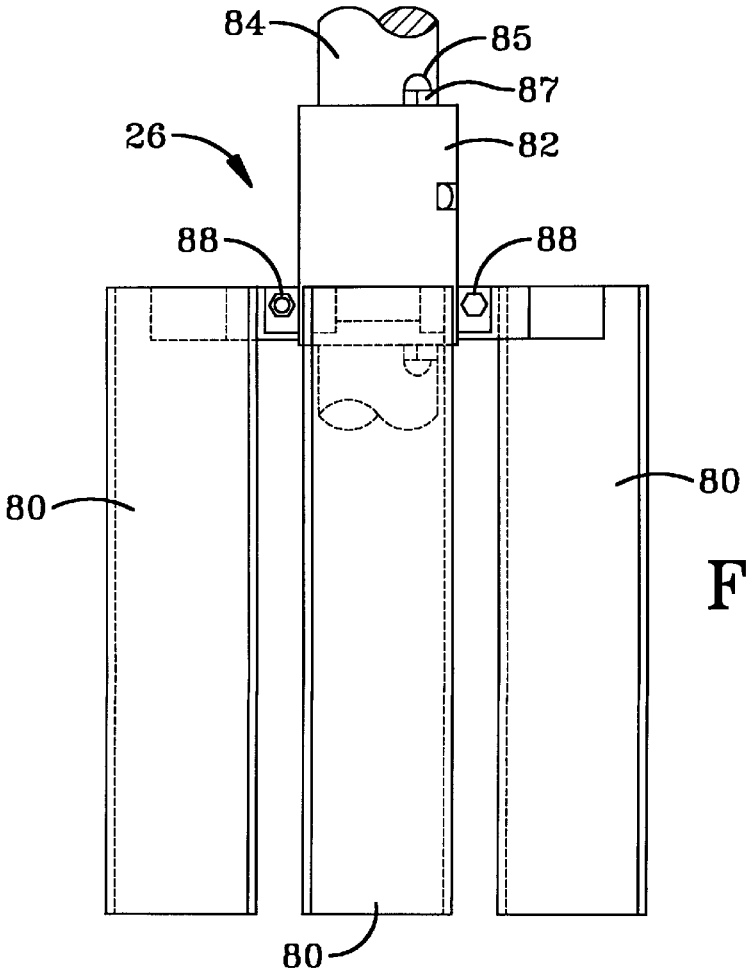
FIG. 5 is side view of the blade assembly.

Referring to FIGS. 4 and 5, large impeller blade assembly 26 is shown with a plurality of blades 80 shown in a folded position. A single blade is shown with dashed lines in FIG. 4 with the blade in its open position. Small impeller blade assembly 26 is essentially the same as large impeller blade assembly 28, except that small impeller blade assembly 26 will be affixed to the very end of mixing shaft 38, as opposed to being slideably engageable along the longitudinal axis of mixing shaft 38. Preferably, large impeller blade assembly 26 has a forty two inch diameter from the ends of oppositely facing blades when the blades are in their open position, while small blade assembly 28 has a twenty six inch diameter when the blades are in their open position. This is referred to as the open blade diameter of the folding blade assembly.

A description of large impeller blade assembly 28 should provide an understanding of the construction and operation of small blade assembly 26. Impeller blade assembly 26 includes a square base 82 having a cylindrical bore 84 with a keyed slot 87 dimensioned to mate with a key portion 85 located along the longitudinal axis of the end of mixer shaft 38. Each blade 80 is held onto base 82 by a hinge 88. The hinge allows blade 80 to move freely from a closed position to an open position during stirring of the fluid and solid mixture. The blades are shaped such that during rotation in the fluid and solid mixture, the combination of centrifugal force and the force against the blade by the radioactive substance causes the blade to move to the open position when the shaft runs at full speed and the blades are submerged in the radioactive substance. Blade assembly 26 can be affixed to mixer shaft 38 by sliding bore 84 over shaft 38 along the longitudinal direction of shaft 38, so that the keyed slot 87 of bore 84 lines up with the key portion 85 on mixer shaft 38. Once blade assembly 26 reaches a desired location on mixer shaft 38, it can be locked into place by a setscrew 84. As previously stated, the desired location will depend on the amount of radioactive substance that remains in the vessel, and therefore large impeller blade 26 can be adjusted along the longitudinal axis of mixer shaft 38 depending on the depth of the radioactive substance remaining in the vessel.

A method for using impeller system 2 for cleaning tank T will be discussed with reference to FIG. 1. Prior to the use of impeller system 2, the depth of the remaining radioactive liquid and solids will be measured by conventional techniques. Tank T typically includes a body 90 and an opening 92. In most tanks of this type, the opening typically has a minimum diameter of eighteen to twenty inches, and therefore the largest part of the first and second coupling assembly 32, 34, first and second mixer shaft 36, 38, and blade assemblies 26, 28 in their folded position must be less than eighteen inches in diameter. Further, the tank may have three openings, one on each end and one in the middle. Three impeller systems are used in this situation. Additionally, a typical tank is sixteen feet in height, has a diameter of ten feet, and is twenty feet long. Typically, the slurry to be mixed is up to thirty percent solids by volume and twenty percent by weight.

After the depth of the tank is measured, an appropriate length of first mixer shaft 36 and second mixer shaft 38 are chosen and coupled to each other and to seal shaft 20 by coupling assembly 22 and 32. The large impeller blade assembly 26 is placed over mixer shaft 38 and slid along the longitudinal axis of the shaft to an optimal location along the shaft, which depends on the measurement of the remaining radioactive substance in tank T. Large blade assembly 26 is then locked into place by setscrew 84. Small blade assembly 28 is then placed at the end of mixer shaft 38, and also locked into place by a setscrew. Preferably, large blade assembly 26 fits on metal shaft 38 where the shaft has a diameter of about three and one half inches, and the end of shaft 38 is turned down from three and one half inches to a diameter of two and one half inches, for an approximate length of nine inches at the end of shaft 38 for receiving small impeller blade assembly 28. The mixer shaft 38 and blade assembly 26 and 28 can now be lowered into the tank until the folding blades 80 of small impeller blade assembly 28 are located just above the bottom of tank T, and base 8 comes to rest on the top of tank opening 92.

Once mixer shaft 24 and impeller blade assembly 26 and 28 are lowered into the tank at the resting position, motor 1 can be turned on to begin rotation of the mixer shaft assembly 24. In the preferred embodiment, mixer shaft assembly 24 is accelerated until it rotates at a speed of sixty-eight revolutions per minute. Upon the shaft assembly reaching full speed rotation, impeller blades 80 on large and small impeller blade assembly 26 and 28 open up into their operating positions, rotating ninety degrees along hinges 88, and mixing liquid and solid radioactive waste into a slurry that can be pumped out of tank T. The combination of centrifugal force and force by the radioactive substance cause the blades to rotate along their respective hinges to their open position. After the operation of mixing and pumping out of the radioactive waste material is complete, motor 1 is turned off and mixer shaft assembly 24 comes to rest, causing blades 80 of blade assembly 26 and 28 to return to their folded position. The mixer shaft and blade assemblies can then be removed from the tank, and the tank can be filled with concrete or the like for disposal.

The foregoing description is a specific embodiment of the present invention. It should be appreciated that this embodiment is described for purposes only, and that numerous alterations and modifications may be practiced by those skilled in the art without departing from the spirit and scope of the invention. It is intended that all such modifications and alterations be included insofar as they come within the scope of the invention as claimed or the equivalence thereof.

What is claimed is:

1. A method for stirring a radioactive material in a vessel having a combination of liquid and solid substances until that combination turns into a liquid slurry that can be pumped out of the vessel, the vessel having a vessel opening, said method comprising the steps of:

providing an impeller mixer assembly having a first folding blade assembly disposed at an end of a mixing shaft assembly, said mixing shaft assembly rotatable by motor means and said folding blade assembly having an open position and a folded position;

inserting the end of said mixing shaft assembly having said folding blade assembly disposed at the end in its folded position through the vessel opening and locating the folding blade assembly at a predetermined depth in radioactive material to be stirred;

rotating said impeller shaft assembly by said motor means to a predetermined speed and causing said folding blade assembly to enter the open position from its folded position and mixing the combination of liquid and solids to a pumpable slurry;

pumping the slurry out of the vessel until the vessel is empty;

causing said impeller mixer assembly to stop rotating by said motor means so that said folding blade assembly returns to its folded position; and removing the end of said impeller mixer shaft assembly from the vessel through the vessel opening.

2. The method as defined in claim 1, wherein the step of providing an impeller mixer assembly having a first folding blade assembly disposed at an end of the mixing shaft assembly, includes the step of providing that said first blade assembly is slideably engageable along the longitudinal axis of said mixing shaft assembly.

3. The method as defined in claim 2, and further including the step of determining the depth of the radioactive material in the vessel.

4. The method as defined in claim 3, and further including the step of sliding said first blade assembly at a location determined by the measurement of the depth of the radioactive material.

5. The method as defined in claim 4, and further including the step of providing a second blade assembly disposed at the very end of said mixing shaft assembly, said second blade assembly have a diameter, when in the open position, is less than the diameter of the first blade assembly when in the open position.

6. An impeller mixer comprising:

a motor rotatable seal shaft having a frusto-conical end;

a mechanical seal for sealing the interface between the seal shaft and an opening to a base having said seal shaft extending therethrough;

a first mixer shaft for connecting to said seal shaft for rotation with said seal shaft, said first mixer shaft having a pair of frusto-conical ends;

a first intank coupling assembly for connecting said seal shaft and said first mixer shaft, said first intake coupling assembly having a pair of connectable collars, each collar having tapered bores for receiving the frusto-conical ends of said seal shaft and said first mixer shaft, having diameters smaller that the diameters of said frusto-conical ends to prevent the frusto-conical ends from sliding out of said respective collars; said first intake coupling assembly including connectors for connecting said collars together to render said first mixer shaft rotatable with said seal shaft;

a second mixer shaft insertable into a vessel containing radioactive waste, the radioactive waste containing liquid and solid materials, said second mixer shaft having a frusto-conical end and a free end;

a second intake coupling assembly for coupling said first mixer shaft with said second mixer shaft, said second intake coupling assembly having a pair of connectable collars, each collar having tapered bores for receiving the frusto-conical ends of said first mixer shaft and said second mixer shaft, and having diameters smaller than the diameters of said respective frusto-conical ends of said first mixer shaft and said second mixer shaft to prevent the frusto-conical ends from sliding out of said respective collars; said second intank coupling assembly including connectors for connecting said collars together to render said second mixer shaft rotatable with said first mixer assembly;

a large impeller blade assembly comprising a first blade base having a cylindrical bore releasably fixed on said second mixer shaft, said large blade assembly including: means for licking large blade assembly at selected places on said second mixer shaft, foldable first blades attachable to said first blade base, and a first hinge for mounting each of said first blades to said first blade base, said first blades being moveable from a folded position to an open position in response to rotation of said second mixer shaft in the radioactive waste in the vessel; and a smaller impeller blade assembly comprising a second blade base having a cylindrical bore releasably fixed on the on the free end of said second mixer shaft, said small blade assembly including: foldable second blades smaller than said first blades and being attachable to said second blade base, and a second hinge for mounting each of said second blades to said second blade base, said second blades being movable from a folded position to an open position in response to rotation of said second mixer shaft in the radioactive waste in the vessel.

7. An impeller mixer according to claim 6 and further including:

a reducer output shaft connected to and rotated by a motor driven reducer; and a low speed coupling hub connecting said reducer output shaft to said seal shaft, rendering said seal shaft rotatable with said reducer output shaft.

* * * * *